United States Patent [19]

Kralik

[11] Patent Number: 4,869,504

[45] Date of Patent: Sep. 26, 1989

[54] FOOTBALL AND LACING FOR FOOTBALLS

[75] Inventor: Douglas R. Kralik, Rolla, Mo.

[73] Assignee: Figgie International Inc., Richmond, Va.

[21] Appl. No.: 248,908

[22] Filed: Sep. 26, 1988

[51] Int. Cl.[4] ..... A63B 41/08

[52] U.S. Cl. ..... 273/65 A; 273/65 EG

[58] Field of Search ..... 273/65 R, 65 A, 65 ED, 273/65 EG, 65 F

[56] References Cited

U.S. PATENT DOCUMENTS

| | | | |
|---|---|---|---|
| 1,537,988 | 5/1925 | Dillinger | 273/65 A |
| 1,900,544 | 3/1933 | Craig | 273/65 A |
| 4,053,156 | 10/1977 | Bai | 273/65 ED |

*Primary Examiner*—George J. Marlo

*Attorney, Agent, or Firm*—Senniger, Powers, Leavitt and Roedel

[57] ABSTRACT

A football comprising an outer shell having a central portion and tapered end portions, and a molded plastic lacing assembly extending along the central portion of the shell. The lacing assembly comprises an elongate fastener plate secured to the shell, a lacing member configured to resemble football lacing, and a plurality of interengageable quick-fastening components on said fastener plate and lacing member for snap-fastening the lacing member to the said fastener plate. The quick-fastening components may comprise a plurality of holes in the fastener plate and a plurality of snap fastening elements projecting from the lacing member adapted to be pressed into the holes in the fastener plate.

20 Claims, 4 Drawing Sheets

FOOTBALL AND LACING FOR FOOTBALLS

BACKGROUND OF THE INVENTION

This invention relates to footballs, and in particular to the lacing for footballs.

Conventional footballs have lacing on their outer shells to close the football and to provide a hand grip to facilitate handling the football. This lacing has generally been applied by hand. Lace holes are die punched through the outer shell, the lining, and the lining support or stay (if there is one). The lacer typically uses an awl to thread the lace, (which is usually made of Dawhide), through the prepunched holes. Often the lacer uses a special tongue or support to protect the bladder from damage during lacing. The process of hand lacing the football is tedious and time consuming, and adds substantially to the cost of manufacturing footballs. Attempts have been made to provide substitutes for conventional lacing, but for various reasons these have not been satisfactory. Reference may be had to U.S. Pat. Nos. 2,182,053, 2,295,815, and 2,653,818 for example footballs having imitation lacing.

SUMMARY OF THE INVENTION

It is among the objects of the present invention to provide a football with lacing that can be quickly and easily applied, and in particular to provide a preformed lacing assembly that can be easily applied as a unit to the outer shell of a football. It is also among the objects of the present invention to provide such a preformed lacing assembly in which the lacing has the appearance and configuration of conventional lacing and feels like conventional lacing to provide good. gripping characteristics. It is also among the several objects of the present invention to provide such a preformed lacing assembly which includes a lacing member and a fastening plate which can be fastened together to sandwich the outer shell of the football therebetween, thereby securely attaching the lacing to the football.

Generally, the football of the present invention comprises a outer shell of conventional shape, having a relatively large central portion and tapering end portions. A molded plastic lacing assembly extends along the central portion of the shell. This lacing assembly comprises a molded plastic fastener plate secured to the outer shell, and a molded plastic lacing member configured to resemble conventional football lacing. There are a plurality of interengageable quick-fastening components on the fastener plate and the lacing member for the quick fastening of the lacing member to the fastening plate to secure the lacing member to the football.

In the preferred embodiment the interengageable quick-fastening components are formed for snap-fastening the lacing member to the fastener plate. These components preferably comprise a plurality of holes in the fastener plate and a plurality of snap fastening elements projecting from the lacing member and adapted to be pressed into the holes in the fastener plate. These snap fastening elements may comprise a stem with a head at the outer nd of the stem having a larger cross-section than its respective hole in the fastener plate, but adapted to deform to pass through the hole and spring back to lock the element in the hole.

The lacing member preferably comprises a relatively long narrow central strip running the length of the lacing member, and a plurality of relatively short narrow cross strips integral with said central strip and extending transversely of the central strip at regular intervals along the central strip. The snap fastening elements are located at the ends of the cross strip members. The fastener plate is preferably disposed inside the outer shell of a football and has a plurality of bosses projecting outwardly into holes in the outer shell. Each boss has an axial bore therethrough constituting one of the holes in the fastener plate.

The lacing assembly of the present invention provides a preformed lacing unit that can be quickly and easily applied to the outer shell of a football. The lacing assembly includes a lacing member having the appearance and configuration of conventional lacing, and thus provides the look and feel of conventional lacing, with good gripping characteristics. The lacing assembly includes a lacing member and a fastener plate which can be fastened together to sandwich the outer shell of the football therebetween, and thus securely attach the lacing to the football.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENTS

Figure 1:
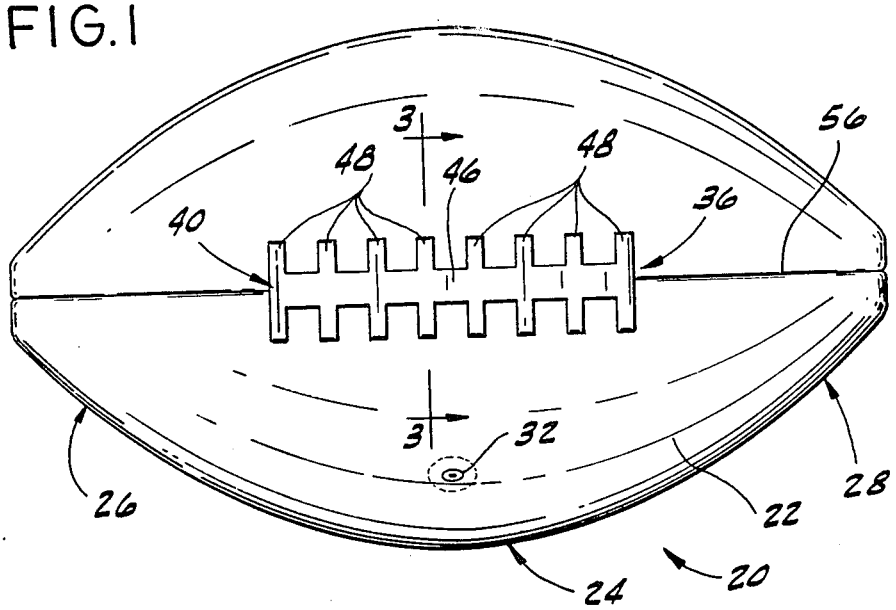
FIG. 1 is a top plan view of a football constructed according to the principles of this invention, showing the lacing member.
Figure 2:
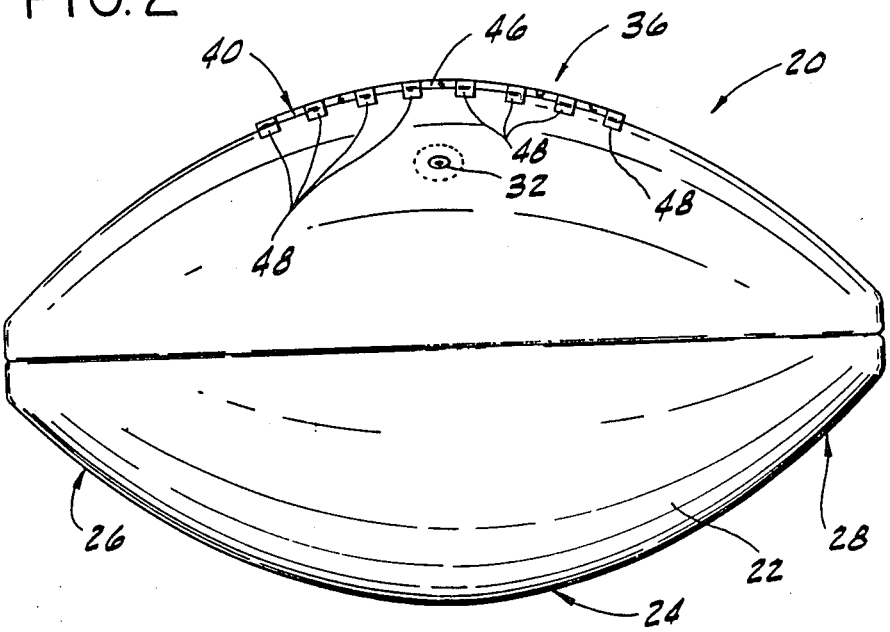
FIG. 2 is a side elevation view of the football, showing the lacing member.

A football constructed according to the principles of this invention is indicated generally at 20 in FIGS. 1 and 2. The football 20 comprises an outer shell 22 having a bulbous central portion 24 and tapered end portions 26 and 28. The outer shell 22 surrounds an air bladder 30 (FIG. 3), which can be filled via a valve 32 which projects through the outer shell 22. The football 20 may optionally include a liner 34 (FIG. 3) on the inside of the outer shell 22 having a shape generally corresponding to the shape of the outer shell.

In accordance with this invention, a molded plastic lacing assembly, generally designated 36, extends along the central portion of the outer shell 22. The lacing assembly 36 comprises elongate fastener plate means 38, made of molded plastic. For example, the fastener plate means 38 may be molded from polypropylene, or other suitable thermoplastic material. The fastener plate means 38 extends along the central portion of the outer shell 22 and is secured in fixed position with respect to the outer shell. The lacing assembly further comprises a lacing member 40, also made of molded plastic and configured to resemble conventional football lacing For example, the lacing member 40 plate means may be molded from polypropylene, or other suitable thermoplastic material.

The lacing assembly 36 also includes a plurality of interengageable quick-fastening components on the fastener plate means 38 and the lacing member 40 for quick fastening of the lacing member to the fastener plate means. These interengageable quick-fastening components are preferably formed for snap-fastening of the lacing member 40 to the fastener plate means 38, and may comprise a plurality of holes 42 (eight in the first preferred embodiment) spaced at intervals along the fastener plate means, and a plurality of snap fastening elements 44 projecting from the lacing member 40 adapted to be pressed into the holes 42 in the fastener plate means for snap-fastening the lacing member to the fastener plate means.

Figure 3:
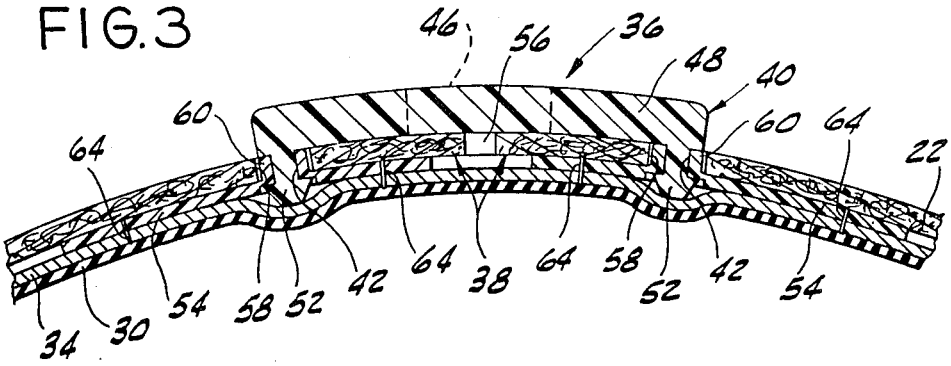
FIG. 3 is a partial transverse cross sectional view of the football taken on line 3—3 of FIG. 1, showing the interengagement between the lacing member and fastener plates.
Figure 4:
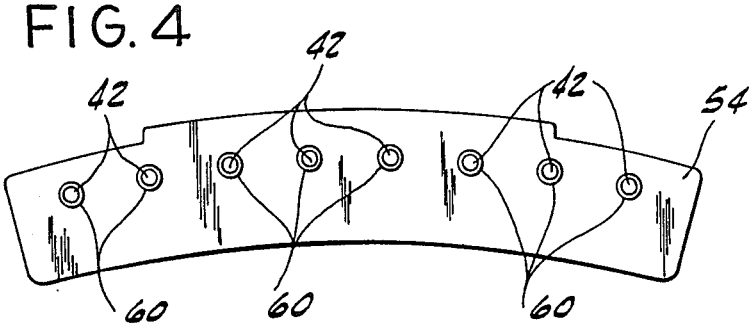
FIG. 4 is a top plan view of one of the fastener plates.

The lacing member 40 preferably comprises a relatively long narrow central strip 46 running the length of the lacing member, and a plurality of relatively short narrow cross strips 48 integral with the central strip 46 and extending transversely of the central strip at regular intervals along the central strip. The cross strips 48 may have the same thickness as the central strip 46 (as shown in FIGS. 2 and 3) or the cross strips 48 may be thicker than the central strip 46. The fastening elements 44 project downwardly from the ends of each of the cross strips 48. Each snap-fastener element 44 on the lacing member 40 comprises a stem 50 integrally connected at one end (constituting its inner end) to the lacing member, and a head 52 at the outer end of the stem 50, the head having a cross-sectional dimension greater than the cross-sectional dimension of its respective hole 42 in the fastener plate means 38. The head 52 is adapted to deform to allow the head 52 to pass through its respective hole 42 and to resiliently spring back to its undeformed shape to lock the snap-fastener element 44 in the hole 42. The heads 52 are preferably tapered to facilitate their insertion through the holes in the fastener plate means, and may be made hollow to facilitate their deformation.

Figure 5:
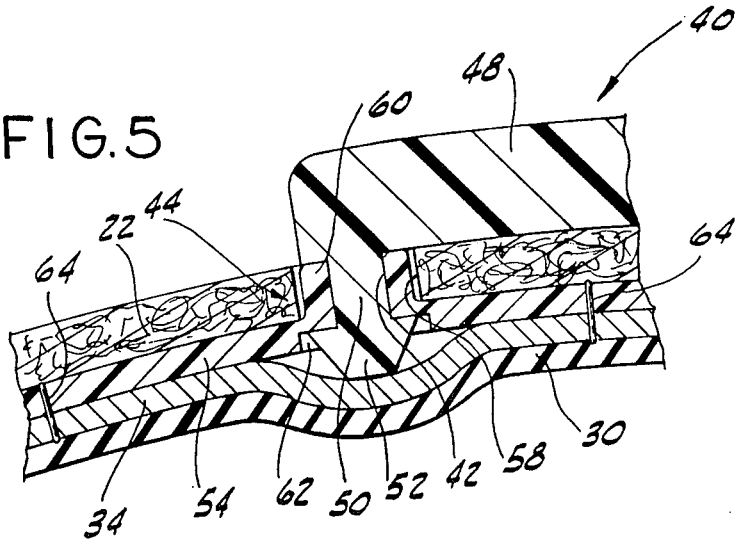
FIG. 5 is an enlarged cross-sectional view of the football, through one of the quick-fastening elements.

The fastener plate means 38 is preferably disposed on the inside of the outer shell 22, and in this preferred embodiment comprises a pair of elongate generally parallel closely spaced fastener plates 54 which are preferably secured to the liner, between the outer shell and the liner. These fastener plates are secured in fixed position with respect to the outer shell on- opposite sides of a seam 56 in the outer shell running the length of the football 20. The central portion of the outer shell preferably has a series of holes 58 therein spaced at intervals longitudinally along the outer shell. Each of the plates 54 has a plurality of integral bosses 60 spaced at intervals along the plate and in registry with and projecting outwardly into holes 58 in the outer shell 22. The height of each boss 60 preferably corresponds substantially to the thickness of the outer shell 22 whereby the outer free end of each boss is substantially flush with the surface of the outer shell (see FIG. 5). Each of the bosses 60 has an axial hole therethrough constituting one of said holes 42 in the fastener plate means. A countersunk well 62 may be provided on the underside of the plates 54 around each hole 42, to receive the head 52 from its respective fastening component 44. The fastener plates 54 are suitably attached to the liner as by stitching 64.

Figure 6:
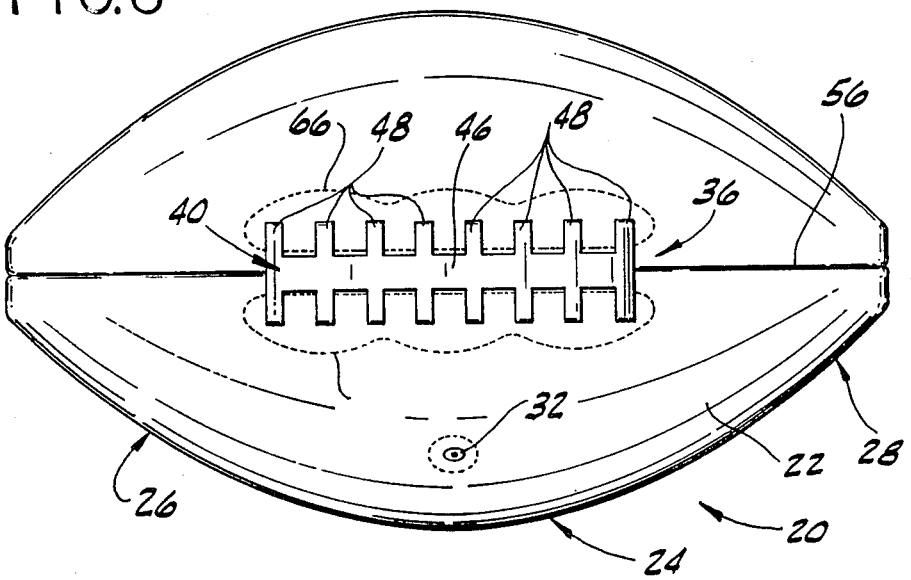
FIG. 6 is a top plan view of a second embodiment of a football constructed according to the principles of this invention.
Figure 7:
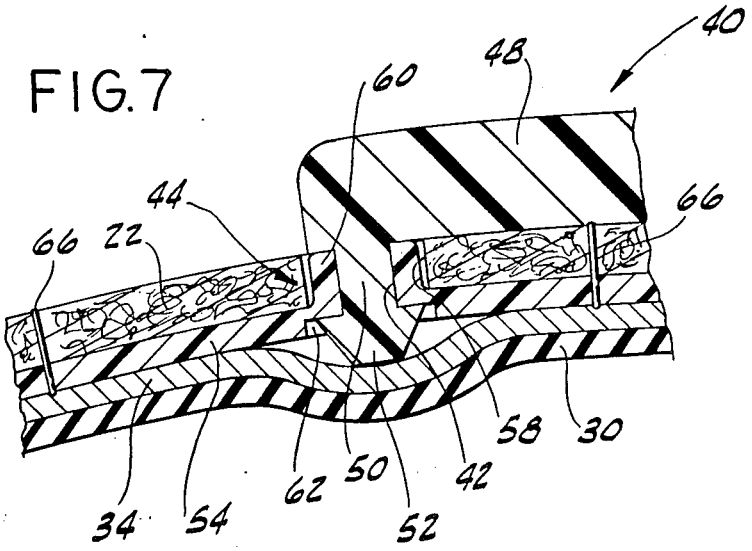
FIG. 7 is an enlarged cross-sectional view of the second embodiment, through one of the quick-fastening elements.

In a second preferred embodiment of the invention shown in FIGS. 6 and 7, the fastener plates 54, constituting the fastener plate means 38, are secured directly to the outer shell 22 of the football with stitching 66. The arrangement of the stitching 66 in FIG. 6 is the same as might be used for stitching 64 described above. The construction of the second embodiment might be used, for example in a football without a liner 34. If no liner 34 is provided, then the heads 52 of the fastener elements 44 should be made blunt to avoid puncturing the bladder 30. The fastener plates 54 might also be stitched to the outer shell so that stitching 66 enhances the appearance of the football.

Figure 8:
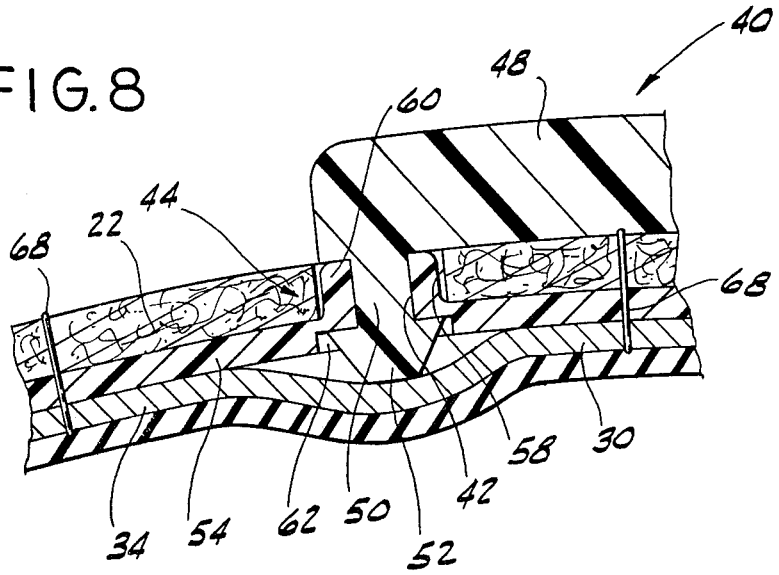
FIG. 8 is an enlarged cross-sectional view of a third embodiment of a football constructed according to the principles of this invention, through one of the quick-fastening elements.

In a third preferred embodiment of the present invention shown in FIG. 8, the fastener plates 54, constituting the fastener plate means 38, are secured to both the outer shell 22 of the football and to the liner 34 of the football, with stitching 68 extending through all three layers. The arrangement of the stitching 68 may be the same as stitching 66 shown in FIG. 6. The construction of the third embodiment would be used to provide additional support and stability for the plates 54 and also so that the stitching 68 will enhance the appearance of the football.

Figure 9:
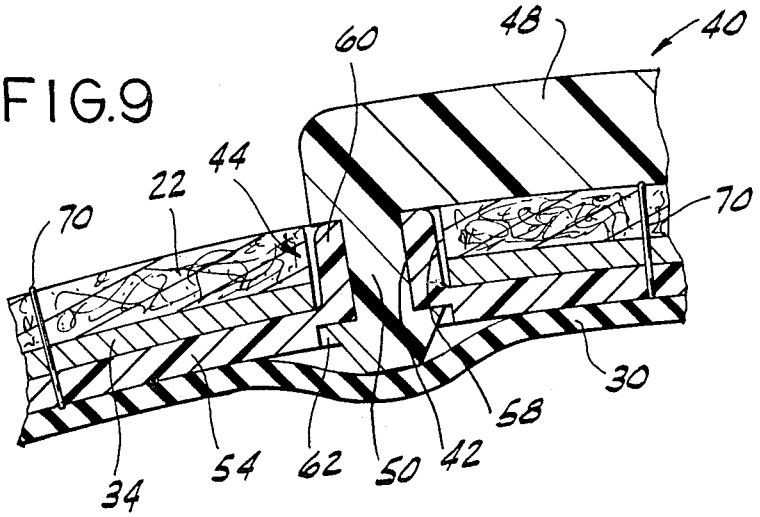
FIG. 9 is an enlarged cross-sectional view of a fourth embodiment of a football constructed according to the principles of this invention.

In a fourth embodiment of the present invention shown in FIG. 9, the fastener plates 54, constituting the fastener plate means 38, are positioned below both the outer shell 22 and the liner 34 of the football. The liner 34 is provided with the appropriate holes aligned with the holes in the outer shell 22, and the stems 50 of fastening elements 44 and the bosses 60 are elongated to accommodate the additional ply of material (liner 34) above the plates 54. Again the heads 52 of the fastener elements 44 should be made blunt to avoid puncturing the bladder 30. The plates 54 may be attached to the liner 34 or to both liner 34 and shell 22 with stitching 70.

Of course the stitching used to secure the plates 54 could be omitted, or replaced with some other fastening means, such as adhesive, if desired.

OPERATION

The football 20 of the present invention is assembled like a conventional football, except that the fastener plates 54 are secured between the outer shell 22 and the liner 30 with the bosses 60 on each plate aligned with and projecting outwardly into the holes 58 in the outer shell. The lacing member 40 can be quickly and easily installed on the football by aligning the fastening elements 44 at the ends of the cross strips 48 with the holes 42 in the fastener plates 54. The lacing member 40 can then be snap-locked onto the football by pressing the lacing member against the fastening plates. The tapered shape of the heads 52 facilitates their entry into the holes 42 in the fastening plates 54. Once the heads 52 pass through their respective holes 42, they resiliently spring back to their original size and shape, thereby engaging the underside of the fastening plate and securing the lacing member 40 to the football.

The lacing member 40 thus provides a durable lacing structure on the football 20 that has the appearance of conventional lacing and provides good gripping characteristics, while reducing the time and cost of manufacture compared to conventional footballs.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A football comprising an outer shell having a central portion and tapered end portions, and a molded plastic lacing assembly extending along the central portion of the shell, said lacing assembly comprising elongate fastener plate means of molded plastic secured in fixed position with respect to the shell and extending along the central portion of the shell, a lacing member of molded plastic configured to resemble football lacing, and a plurality of interengageable quick-fastening components on said fastener plate means and said lacing member for quick fastening of said lacing member to said fastener plate means.

2. A football as set forth in claim 1 wherein said interengageable quick-fastening components are formed for snap-fastening of said lacing member to said fastener plate means.

3. A football as set forth in claim 2 wherein said quick-fastening components comprise a plurality of holes spaced at intervals along said fastener plate means, and a plurality of snap fastening elements projecting from said lacing member adapted to be pressed into the holes in said fastener plate means for snap-fastening the lacing member to said fastener plate means.

4. A football as set forth in claim 3 wherein said lacing member comprises a relatively long narrow central strip running the length of the lacing member, and a plurality of relatively short narrow cross strips integral with said central strip and extending transversely of the central strip at regular intervals along the central strip, said fastening elements being located at the ends of the cross strip members.

5. A football as set forth in claim 3 wherein each snap-fastener element on the lacing member comprises a stem integrally connected at one end, constituting its inner end, to the lacing member, and a head at the outer end of the stem, said head having a cross-sectional dimension greater than the cross-sectional dimension of a respective hole in said fastener plate means and being adapted to deform to allow passage of the head through the hole to a position wherein the head is adapted to spring back to its undeformed shape to lock the snap-fastener element in the hole.

6. A football as set forth in claim 5 wherein said fastener plate means is disposed on the inside of the outer shell and has a plurality of integral bosses projecting outwardly into holes in the outer shell, each boss having an axial bore therethrough constituting one of said holes in said fastener plate means, and each boss having a length substantially corresponding to the thickness of the outer shell whereby the outer end of the boss is substantially flush with the surface of the outer shell.

7. A football as set forth in claim 6 wherein said fastener plate means comprises a pair of elongate generally parallel closely-spaced fastener plates secured in fixed position with respect to the shell on the inside of the shell on opposite sides of a seam in the outer shell running the length of the football.

8. A football as set forth in claim 7 wherein said football further comprises a liner on the inside of the outer shell having a shape generally corresponding to the shape of the shell, and means attaching said fastener plates to the liner on the outside surface of the liner.

9. A football as set forth in claim 1 herein said football further comprises a liner on the inside of the outer shell having a shape generally-corresponding to the shape of the shell, and means attaching said fastener plate means to the liner on the outside surface of the liner.

10. A football as set forth in claim 9 wherein said interengageable quick-fastening components are formed for snap-fastening said lacing member to said fastener plate means.

11. A football as set forth in claim 10 wherein said central portion of the outer shell has a series of holes therein spaced at intervals along the shell, said quick-fastening components comprising a series of holes spaced at intervals along said fastener plate means and in registry with the holes in the outer shell, and a series of snap fastening elements projecting from said lacing member and adapted to be pressed through said holes in said outer shell into the holes in said fastener plate means for snap-fastening the lacing member to said fastener plate means with the outer shell disposed therebetween.

12. A football as set forth in claim 11 wherein said lacing member comprises a relatively long narrow central strip running the length of the lacing member, and a plurality of relatively short narrow cross strips integral with said central strip and extending transversely of the central strip at regular intervals along the central strip, said fastening elements being located at the ends of the cross strip members.

13. A football as set forth in claim 11 wherein each snap-fastener element on the lacing member comprises a stem integrally connected at one end, constituting its inner end, to the lacing member, and a head at the outer end of the stem, said head having a cross-sectional dimension greater than the cross-sectional dimension of a respective hole in said fastener plate means and being adapted to deform to allow passage of the head through the hole to a position wherein the head is adapted to spring back to its undeformed shape to lock the snap-fastener element in the hole.

14. A football as set forth in claim 11 wherein said fastener plate means comprises a pair of elongate generally parallel closely-spaced fastener plates attached to the liner, each fastener plate having a plurality of holes therethrough spaced at intervals along the plate, said outer shell having holes therein corresponding to and in registry with the holes in the fastener plates, and said lacing member having two generally parallel rows of snap fastening elements projecting therefrom adapted to be pressed through the holes in said outer shell into the holes in the fastener plates.

15. A football as set forth in claim 14 wherein each fastener plate has a plurality of integral bosses projecting outwardly into respective holes in the outer shell, each boss having an axial bore therethrough constituting one of said holes in the fastener plate, and each boss having a length substantially corresponding to the thickness of the outer shell whereby the outer end of the boss is substantially flush with the outer surface of the shell.

16. A lacing assembly for a football comprising elongate fastener plate means of molded plastic adapted to be secured in fixed position with respect-to the shell of a football, a lacing member of molded plastic configured to resemble football lacing, and a plurality of interengageable quick-fastening components on said fastener plate means and said lacing member for quick fastening of said lacing member to said fastener plate means.

17. A football as set forth in claim 16 wherein said interengageable quick-fastening components are formed for snap-fastening of said lacing member to said fastener plate means.

18. A lacing assembly as set forth in claim 17 wherein said quick-fastening components comprise a plurality of holes spaced at intervals along said fastener plate means, and a plurality of snap fastening elements projecting from said lacing member adapted to be pressed into the holes in said fastener plate means for snap-fastening the lacing member to said fastener plate means.

19. A lacing assembly as set forth in claim 18 wherein said lacing member comprises a relatively long narrow central strip running the length of the lacing member, and a plurality of relatively short narrow cross strips integral with said central strip and extending transversely of the central strip at regular intervals along the central strip, said fastening elements being located at the ends of the cross strip members.

20. A lacing assembly as set forth in claim 18 wherein each snap-fastener element on the lacing member comprises a stem integrally connected at one end, constituting its inner end, to the lacing member, and a head at the outer end of the stem, said head having a cross-sectional dimension less than the cross-sectional dimension of a respective hole in said fastener plate means and being adapted to deform to allow passage of the head through the hole to a position wherein the head is adapted to spring back to its undeformed shape to lock the snap-fastener element in the hole.

* * * * *